United States Patent [19]

Darling et al.

[11] 4,041,556

[45] Aug. 16, 1977

[54] FLUSHING METHOD AND APPARATUS

[76] Inventors: Stanley N. Darling; Reyi Darling, both of 1248 Craigflower Road, Victoria, British Columbia, Canada, V9A 2Y6

[21] Appl. No.: 672,152

[22] Filed: Mar. 31, 1976

[30] Foreign Application Priority Data

Apr. 9, 1975 Canada ..... 224379

[51] Int. Cl.[2] ..... E03D 1/34

[52] U.S. Cl. ..... 4/52; 251/33

[58] Field of Search ..... 4/52, 41, 67 R, 249; 251/33

[56] References Cited

U.S. PATENT DOCUMENTS

| | | | |
|---|---|---|---|
| 2,470,798 | 5/1949 | White | 251/33 X |
| 2,487,418 | 11/1949 | Birkemeier et al. | 251/33 X |
| 2,729,242 | 1/1956 | Olson | 251/33 X |
| 2,882,533 | 4/1959 | Gray | 4/52 X |
| 3,162,212 | 12/1964 | Leding | 251/33 X |
| 3,466,673 | 9/1969 | Boccard | 4/52 |

*Primary Examiner*—Henry K. Artis

*Attorney, Agent, or Firm*—Larson, Taylor and Hinds

[57] ABSTRACT

A body having a channel therein in which a flow valve is movably mounted. An inlet communicating with the channel near one end thereof, and an outlet communicating with the channel spaced from said inlet. The flow valve has a head near the end of the channel in communication with the inlet and adapted normally to engage a seat in the channel to close the latter, a stem of smaller cross section that the head, and a guide portion remote from the head and slidably fitting in the channel. Means for moving the valve to move the head thereof off the seat to permit water to flow from the inlet past the head to the outlet, said water gradually moving the head back on the seat.

23 Claims, 11 Drawing Figures

FLUSHING METHOD AND APPARATUS

Figure 1:
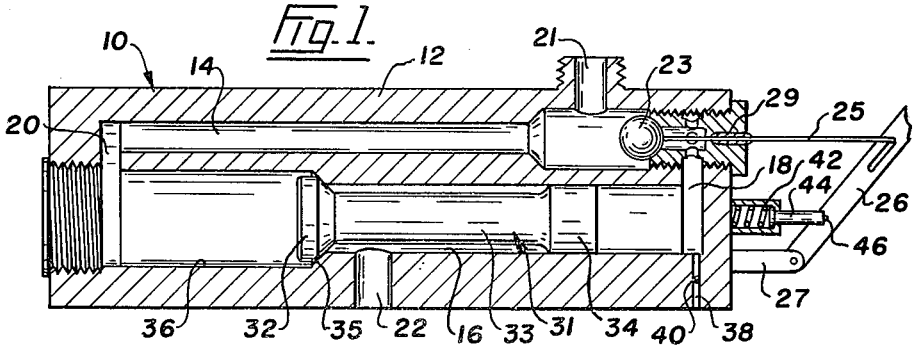

This invention relates to a flushing method and apparatus, principally for toilets, but which may be used for other purposes.

The conventional flushing mechanism used in domestic toilets is positioned in a tank or reservoir that contains the water to be used for the next flush of the toilet. The tanks are liable to give trouble. Because these mechanisms are submerged in water then surrounded by air they are liable to corrosion. In addition the cisterns or tanks need to hold a considerable volume of water and are relatively difficult to install. As a result, a relatively large volume of water is used each time the toilet is flushed. These toilets sometimes malfunction, require repairing, and the ball valve or flap valve thereof that should close after each flushing action sometimes does not seat properly so that water continues to flow into the bowl, resulting in a wastage of water.

Another disadvantage of the tank type flushing systems is that sometimes the water can be siphoned out of the tanks back into the water supply system when the water in the latter is cut off. This is very undesirable since the water in these tanks is usually dirty.

Diaphragm types of flush valves have been used, particularly in public washrooms. These diaphragm valves rely on differences in hydrostatic pressure to operate, and are comparatively complicated in construction and operation. As this type of valve goes through its operational procedure in approximately 2 seconds, it requires a large supply pipe for the incoming water. This supply of water must simultaneously flush the toilet, rinse the bowl and replenish the closet seal. As a result, it has not previously been possible to operate such a valve with the half inch diameter pipe conventionally used in domestic plumbing but a feed pipe of about three times that diameter is required.

The present invention relates to a flushing method and apparatus particularly adopted to carry out this method. The main purpose of this invention is to enable toilets to be adequately and completely flushed with considerably less water than is used with the flushing systems of the prior art. This will not only save an important resource, water, but it will reduce the loads on sewage treatment facilities, thereby allowing a given facility to handle sewage from a larger area. This method and apparatus can be used in homes that have only the standard water piper therein, and they eliminate the necessity of using larger piper in public washrooms. The apparatus is very easily installed and is such that it can be manufactured from plastic or any other suitable materials.

The toilet bowl in common use has a ring around the top thereof with downwardly facing perforations and through which, during flushing action, water is directed over the bowl wall in a rinsing action and to replace the water in the bowl. Simultaneously, a jet of water is directed upwardly from the bottom of the bowl through the uplet of a trapway so as to fill the trapway and start a siphonic flushing action which instantly empties the bowl of the water standing therein. As the rinsing, flushing and replenishment takes place simultaneously a relatively large quantity of water must be instantly available, hence the necessity, in the prior art, of a tank full of water or a large water supply pipe.

The flushing method according to the present invention comprises sequentially rinsing the bowl, flushing out the standing water therefrom while simultaneously rinsing the bowl, and replenishing the water in the bowl, thereby eliminating the necessity of having a large quantity of water instantly available while still thoroughly emptying and cleansing the bowl. Thus, neither a tank nor a large water supply pipe is required, so that the toilet can be supplied by a standard water pipe, usually of a half inch diameter.

One flush valve for carrying out this method and in accordance with this invention comprises a valve body, a channel formed in said body, an inlet in communication with the channel near one end thereof, an outlet in communication with the channel and spaced fron said one end, a flow valve in the channel having a head, a stem of smaller cross section than the head and a guide portion that is a close, slidable fit in the channel and remote from the head, a valve seat in the channel between said one end and the outlet, said valve being reciprocal in the channel between a closed, rest position in which the valve head is located in the valve seat to a second position in which the head is in the vicinity of said one end, the flush valve being adapted to ensure that, in use, liquid can pass the head and out through the outlet at all positions except the closed position, and means to permit movement of the valve to move the head off the valve seat, whereby, in use, when the valve is moved to said second position liquid can pass from the inlet to the outlet and simultaneously move the valve gradually back to the closed, rest position to stop passage of liquid through the outlet.

A preferred form of valve in accordance with the invention, comprises a valve body, first and second channels formed in the body and communicable with each other at first and second passages that are remote from each other. There is an inlet in the first channel and outlet means in the second channel. A first valve is positioned in the first channel reciprocable between a rest position in which it blocks communication between the inlet and the first passage and a second position in which it blocks communication between the inlet and the second passage. There are means to permit movement of the first valve between its rest and second positions. A second valve in the second channel has a head, a stem of smaller cross section than the head and a guide portion that is a close, slidable fit in the second channel and remote from the head. There is a valve seat in the second channel between the second passage and the outlet means. The second valve is reciprocable in the second channel between a closed, rest position in which the valve is seated on the valve seat to a second position in which the head of the valve is in the vicinity of the second passage. The flush valve is adapted to ensure that, in use, liquid can pass by the head of the second valve out of the outlet means at all positions of the second valve except the closed position. The flush valve is provided with a regulating outlet means communicating with the guide portion of the second valve to permit the second valve to return to its closed position and to control the speed of that return. In use, when the first valve is moved to a second position, liquid can pass through the first passage to act against the guide of the second valve to move the second valve from the closed, rest position and enable liquid to pass through the second passage to the outlet means. Simultaneously, the second valve is moved back gradually to the closed, rest position by the pressure of liquid. When the second valve reaches its rest position passage of liquid through the outlet means is stopped.

In a preferred embodiment the outlet means of the flush valve comprises a first outlet and a second outlet in the second channel. In this embodiment the valve guide is elongated and formed with an internal channel, having a port, relatively close to the valve head, communicating with the second channel of the flush valve. A second port in the guide portion of the second valve is able to communicate sequentially with the first and second outlets in the second channel. The second port is positioned so that when the first valve is in its second position, the second port communicates with the second outlet and water from the first passage passes through the first port through the internal channel in the second valve, out of the second port and out of the second outlet. As the second valve moves towards its rest position the second port communicates with the first outlet to enable water to pass through that outlet. This is followed by communication of the area around the valve stem with the second outlet prior to the closing of the valve.

The means to permit movement of the first valve is preferably a reciprocable lever linked to the valve. The lever is desirably spring urged to move the first valve back to its rest position.

In order to permit liquid to pass by the head of the second valve out of one or both of the outlet at all positions of the second valve except the closed position, the head of the valve may be smaller in cross sectional area than that part of the second channel swept by the head. Liquid may pass by the valve head and out of the outlet during all the time that the valve is moving from its second position to its closed or rest position. Alternatively, the part of the second channel swept by the valve head may be formed with by-pass channels that ensure water can pass by the valve head.

Desirably, the valve is provided with holes at the end of each of its channels to permit insertion and removal of the first and second valves. These holes are provided with water proof plugs.

The regulating outlet means may comprise an outlet formed in that part of the second channel adjacent the first passage. The outlet is preferably formed with a valve whose position can be varied to govern the speed of emission of the water as the second valve moves to its closed, rest position. The speed of return of the second valve can thus be controlled.

In a preferred aspect of the invention the valve guide is provided with a spring able to abut a part of the interior of the valve body. The spring is of such a strength that it cannot normally overcome the effect of the water pressure acting on the head of the valve while the valve is closed. This ensures that if the water pressure at the inlet is turned off, the spring can move the seat from the valve and air can enter the first and second channels through the second outlet. This avoids a syphon developing, within the valve. The guide of the valve is preferably shaped so that it does not completely close off the second outlet, to permit access of air into and through the valve.

Figure 2:
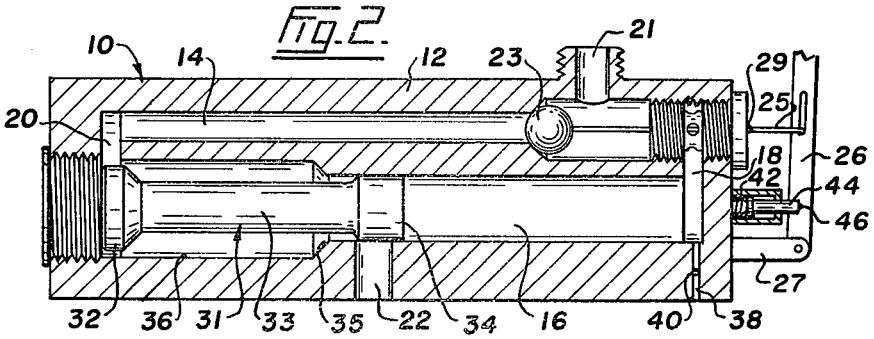
Figure 3:
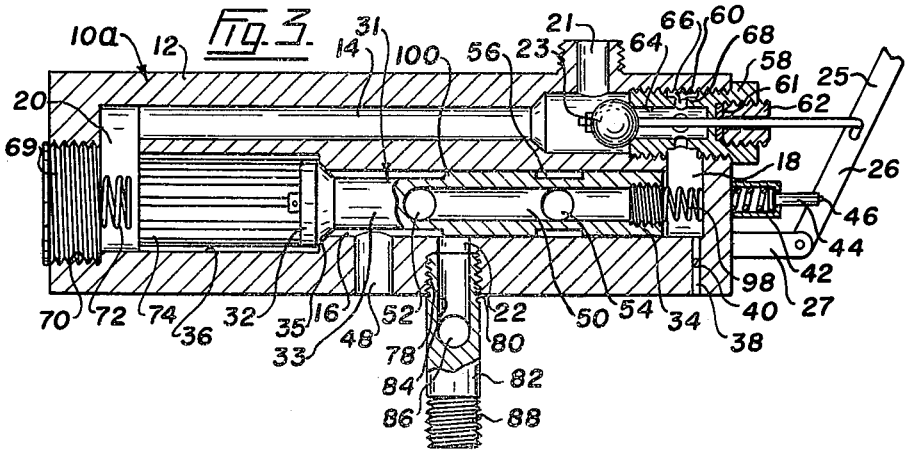
Figure 4:
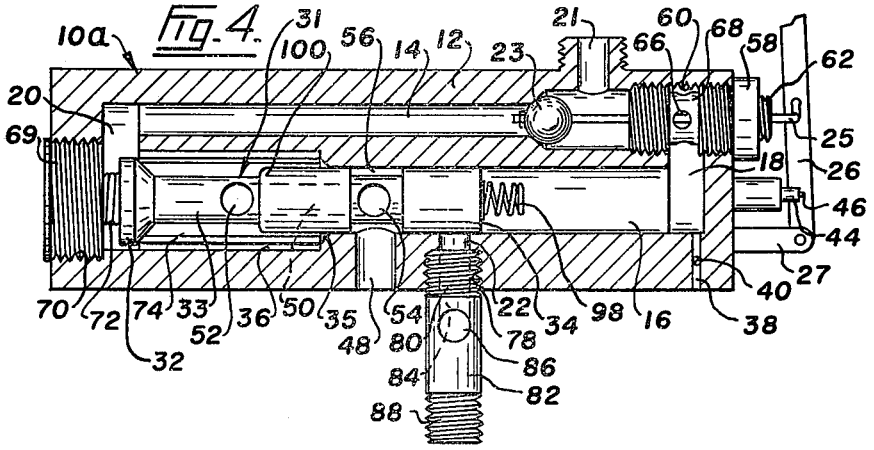
Figure 5:
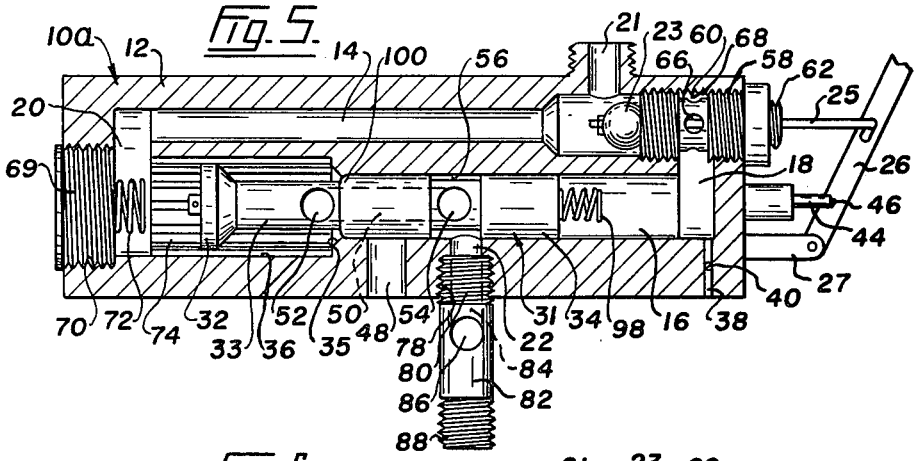
Figure 6:
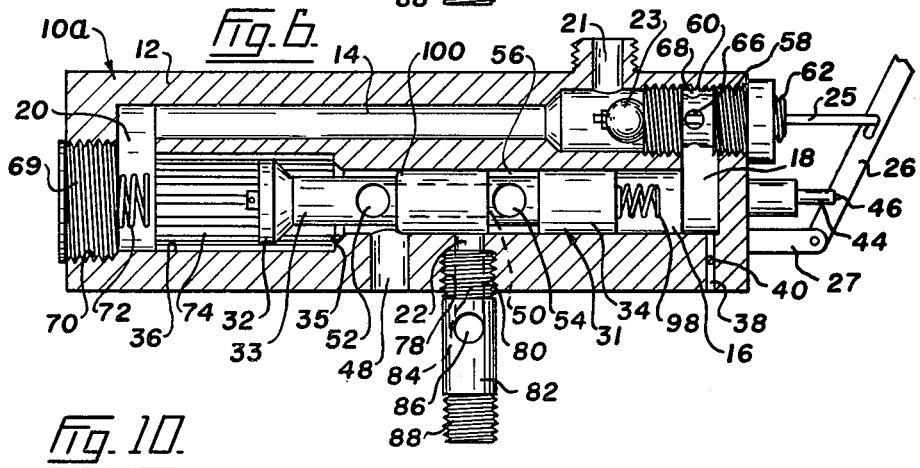
Figure 10:
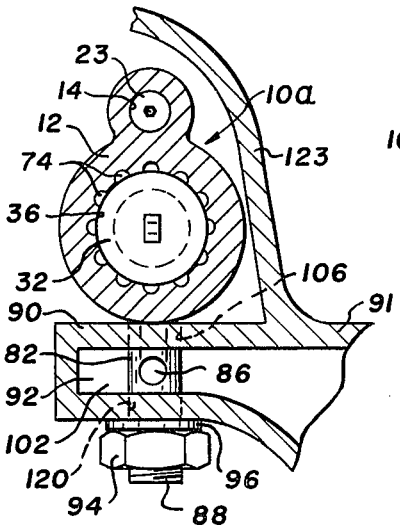
Figure 7:
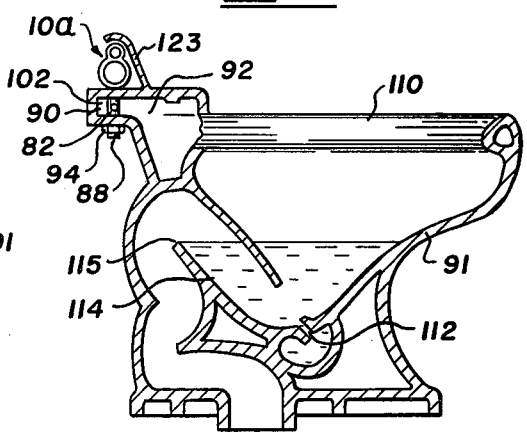
Figure 8:
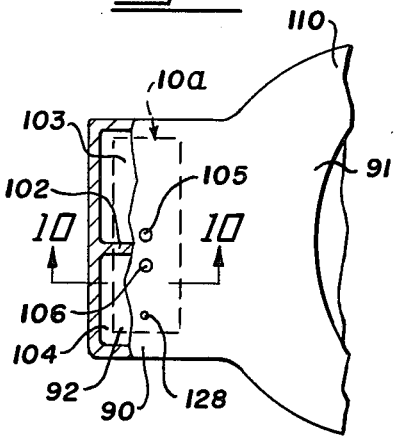
Figure 9:
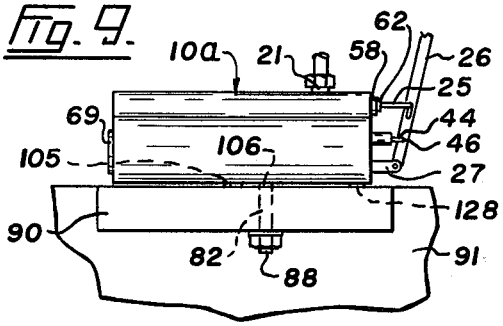
Figure 11:
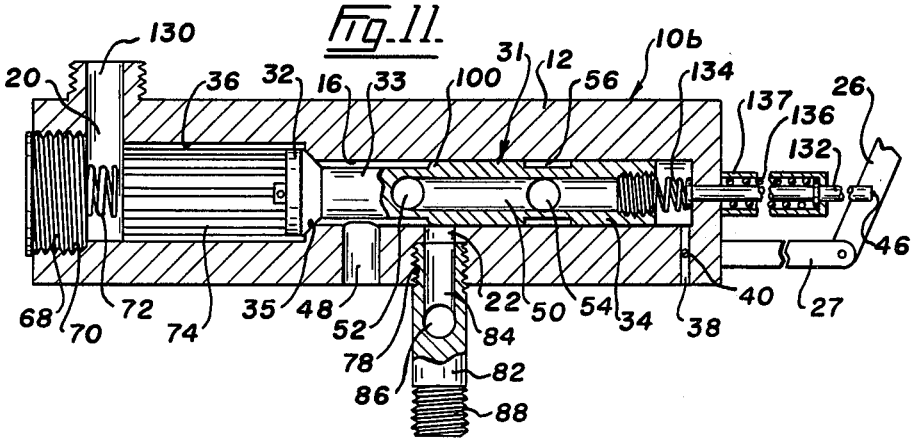

Embodiments of the invention are illustrated in the accompanying drawings in which:

FIG. 1 is a longitudinal section through a simplified embodiment of the flush valve, showing the latter is the closed position, FIG. 2 is a view similar to FIG. 1 showing the valve in the open position, FIG. 3 is a longitudinal section through a preferred form of flush valve in the closed position, FIGS. 4 to 6 are sections similar to FIG. 3, illustrating the valve in its sequential operating positions, FIG. 7 is a diagrammatic longitudinal section through one form of toilet bowl in common use with this flush valve mounted thereon, FIG. 8 is a plan view of the toilet bowl, partly in section, and with the flush valve shown in broken lines, FIG. 9 is an end elevation of a portion of the back of the toilet bowl with the flush valve installed, FIG. 10 is an enlarged cross section through the valve on the line 10—10 of FIG. 8, and FIG. 11 is a view similar to FIG. 3, but illustrates a further embodiment of the invention.

FIGS. 1 and 2 illustrate a simple form of flush valve 10 comprising a valve body 12 having a first channel 14 and a second channel 16. The first channel 14 and the second channel 16 communicate with each other at a first passage 18 and a second passage 20. There is an inlet 21 in the first channel 14 adapted to be connected to a water line, not shown, and outlet means in the second channel 16. In this example, there is a single outlet 22 in the channel 16. A first or control valve 23, preferably in the form of a resilient ball, is positioned in the first channel 14 and is reciprocable between a rest position, as shown in FIG. 1, in which it blocks communication between the inlet 21 and the first passage 18, and a second position, shown in FIG. 2, in which it blocks communication between the inlet 21 and the second passage 20. There are means to permit movement of the first valve 23 between its rest and second positions. In FIGS. 1 and 2 the means comprise a rod 25 attached to a lever 26 which is pivotally connected to a lug 27 attached to the exterior of the valve body 12. The rod 25 extends through a seal 29, which prevents water leaking from the valve body.

There is a second or flow valve 31 positioned in the second channel 16. This second valve 31 has a head 32, a stem 33 of a smaller cross section than the head 32 and a guide 34 that is a close slidable fit in the second channel 16. The second channel 16 is formed with a valve seat 35 positioned between the second passage 20 and the outlet 22. This valve 31 is reciprocable in the second channel 16 between a closed, rest position, as shown in FIG. 1 and a second position, as shown in FIG. 2. In the closed position the valve 31 is seated on the seat 35. In the second position the head 32 of the valve 31 is in the vicinity of the second passage 20. The head 32 of the valve 31 is smaller in cross sectional area than an enlarged portion 36 of the channel 16 swept by the head 32 in moving form is closed to second position. In use, this ensures that water may pass by the valve head 32 and out of the outlet 22 at all positions of the second valve 31 except the closed position.

Channel 16 is provided with an outlet 38 fitted with a valve 40. This outlet communicates with the passage 18 and channel 16 and, by permitting liquid to pass from the valve body 12 as the second valve 31 moves from its second position to its rest position, permits the second valve to return to its closed position. The valve 40 can be adjusted to control the speed of that return. A simple regulating screw turnable in a threaded passageway has proved useful as the valve 40.

Lever 26 is biased to move valve 23 to its rest position by spring 42 acting along rod 44, pivotally connected to lever 26 at 46.

The normal, non-operating position of the flush is as shown in FIG. 1. Liquid pressure through the inlet 21 acts through the channel 14, the second passage 20 and the enlarged position 36 of the second channel 16 to act against the head 32 of the valve 31. The valve is thus maintained on the seat 35. As the first valve 23 is blocking communication between the inlet 21 and the first passage 18 no liquid can flow through the valve.

When the lever 26 is depressed, the valve 23 is moved to the position shown in FIG. 2. Liquid then enters the inlet 21, passes through the first passage 18 and exerts pressure on the second valve 31 to move it to its second position as shown in FIG. 2. Upon release of the lever 26 the lever is urged back to its rest position by spring 42. Liquid then passes through the inlet 21, through the first channel 14, through the second passage 20 and against and around the head 32 of the valve 31. The liquid moving around the valve 31 passes from the outlet 22. Simultaneously with the liquid passing through the outlet 22 the liquid pressure drives the second valve 31 back towards its closed position as shown in FIG. 1.

The embodiment of FIGS. 1 and 2 is useful in any environment in which it is required to deliver a predetermined amount of liquid from a source. In its primary intended use it will be mounted on a toilet bowl, in the manner described subsequently for the embodiment shown in FIGS. 3 to 6, to deliver water to a toilet bowl.

The valve 10 is not capable of carrying out the sequential flushing action referred to above, but it has the advantages of simplicity of construction and operation over the standard types of diaphragm valves.

The flush valve 10*a* of FIGS. 3 to 6 is, in effect, a more sophisticated version of the valve 10 illustrated in FIGS. 1 and 2. Thus, in FIGS. 3 to 6 the reference numerals that have been used in describing FIGS. 1 and 2 are repeated without further description here.

In contrast to valve 10, valve 10*a* has a second outlet 48 in the second channel 16 adjacent outlet 22. The valve guide 34 of valve 31 is elongated and formed with an internal channel 50. There is a first port 52 in the channel 50 relatively close to the valve head 32. This first port 52 communicates with the internal channel 50 of the valve 31 and with the second channel 16. A second port 54, remote from the first port 52, is formed in the guide portion 34 of the valve 31. The guide is formed with a circumferential recess 56 so that the port 54, when in the appropriate alignment, may communicate sequentially with the first outlet 22 and the second outlet 48 in the second channel 16. The second port 54 is positioned so that when the second valve 31 is in its second position—as illustrated in FIG. 4—the second port 54 communicates with the second outlet 48 in the second channel 16. Furthermore, as the second valve 31 moves from the second position as shown in FIG. 4 to the position shown in FIG. 5, that is on its way back to the rest position shown in FIG. 3, the second port 54 communicates with the first outlet 22, and port 48 is closed.

The simple seal 29 illustrated in FIG. 1 and 2 is replaced in the embodiment of FIGS. 3 to 6 by a threaded liquid-proof plug 58 positioned in the threaded hole 60 formed at one end of the first channel 14, adjacent the first passage 18. Plug 58 is further provided with a sealing washer 61 located in position by the threaded plug 62. The sealing washer 61 acting with the threaded plug 62 prevents water leaking from the valve around the rod 25. The plug 58 is provided with an internal channel 64, ports 66 and a circumferential channel 68 so that when the valve 23 is out of contact with the end of the plug 60, that is when the first valve 23 moves from its rest position shown in FIG. 3, liquid can pass from the first channel 14, through the first passage 18 to the second channel 16.

The second channel 16 has a liquid-proof plug 69 threaded into an opening 70 formed at its end. Plugs 58 and 69 permit insertion and removal of the valves 23 and 31 respectively. The plug 69 has attached to it a spring 72 to absorb the shock of contact of the second valve 31 with the valve body 12.

Instead of the valve head 32 being smaller in cross-section than the enlarged portion 36 of the second channel 16 as in FIGS. 1 and 2, the enlarged portion 36 in FIGS. 3 and 6 is provided with by-pass channels 74 as shown most clearly in FIG. 10. Thus, the head 32 contacts the wall of the enlarged portion 36 and provides additional guiding for the valve 31 during most of the movement of the valve.

The outlet 22 is internally threaded at 78 to engage with a first threaded end 80 of a conduit 82. The conduit 82 is formed with an internal passage 84 and is formed with a port 86 connecting the internal passage 84 with the exterior of the conduit. The conduit 82 is also provided with a threaded portion 88 as its outer end. The conduit 82 extends through a flange 90 of a toilet bowl 91, see FIGS. 7 and 10. Flange 90 is formed with an internal channel 92. The flush valve is located in position on the toilet bowl by a nut 94 engaging thread 88 of conduit 82, see FIG. 10. A washer 96 prevents water leaking around the exterior of the conduit 82.

On the end of the guide portion 34 of valve 31 is a spring 98. Spring 98 is of such a strengh that when water pressure is applied against the head 32 of the valve 31 when the valve is in its closed position the spring 98 cannot overcome the water pressure. However, if water pressure to the valve should be cut off, the spring is sufficiently powerful to move the valve 31 so that the head 32 leaves the seat 35. The water contained in the channels 14 and 16 can thus drain through the outlet 48 and air can enter the valve body through said outlet 48. This prevents a syphon developing, which can happen with the conventional closet tank as mentioned above. It should also be noted that the end 100 of the guide portion 34 of valve 31 is rounded off so that the guide portion never completely closes off the outlet 22 when the valve is in the rest position, as clearly shown in FIG. 3. This permits air from the internal channel 92 of the toilet bowl 91 to enter the portion of channel 16 surrounding the stem 33 of the valve 31 through port 86. The liquid from around the stem 33 drains out through the second outlet 48.

By referring to FIG. 8 it will be seen that the internal channel 92 of the flange 90 of the toilet bowl is divided by a wall 102 into sections 103 and 104 having holes 105 and 106, respectively, in the tops thereof. The toilet bowl 91 has the usual rinse rim 110 around the top thereof, said rim having the usual openings therein for directing water from the rim downwardly over the inner surface of the bowl. The interior of rim 110 is in communication with flange section 103 to receive water therefrom.

FIG. 7 illustrates the toilet bowl 91, and as this is a standard construction, the illustration is diagrammatic. This bowl has the usual jet 112 at the bottom thereof for directing water through the uplet 114 of the trapway of the bowl and over the dam 115. The jet 112 is in communication with the interior of flange 90 in the usual manner, but in this case, the jet is in communication only with flange section 104.

When valve 10*a* is to be mounted on the toilet bowl, it is placed on top of flange 90 with outlet 48 in registry with opening 105 and in communication with flange section 103, and conduit 82 extending down through opening 106 and through another opening 120, see FIG. 10, in the bottom of the flange so that port 86 is in communication with flange section 104.

As stated above, toilet bowl 91 is standard excepting that wall 102 has been added within flange 90, and a shield 123 may be mounted on or formed with the bowl in a position to hide valve 10*a.*

In use, the flush valve 10*a* follows sequentially through the steps shown in the FIGS. 3 to 6. FIG. 3 shows the rest position. To flush the valve lever 26 is moved towards the valve body to the position shown in FIG. 4. Valve 23 is thus moved from its rest position to its second position as shown in FIG. 4. Liquid then enters inlet 21 passes through the internal channel 64 of plug 58 and through the second passage 18 to move the second valve 31 to its second position. As soon as the lever 26 is released spring 42 urges it outwardly. The first valve 23 thus starts to move back towards its rest position. When valve 23 starts to move back, water passes from the 21 into the second channel 14 through the passage 20 and against and around the valve head 32 of second valve 31 through the bypass channels 74. Second valve 31 is still in the position shown in FIG. 4 so the water passing around the valve head 32 passes into the first port 52, through the internal channel 50 in valve 31 and out of the second port 54 which communicates, via the circumferential channel 56, with the second outlet 48. This second outlet is the rinse outlet and provides an initial, relatively small output of water which flows through rim 110 and into bowl 91 to rinse the walls of the latter. Simultaneously, the water acts against the head 32 to move it to the position shown in FIG. 5. In this position the liquid passing around the valve head 32 enters the first port 52, passes through the internal channel 50 and out of the second port 54 which communicates, via the circumferential channel 56, with the first outlet 22. While channel 56 is in alignment with the outlet 22 water passes through the outlet. At this time, guide 34 closes off outlet 48 so that water travels only through port 86 to the jet 112 of the bowl.

As the valve progresses to the position shown in FIG. 6, the liquid passing the valve head 32 passes over the stem 33 of the valve 31 and out of the second outlet 48 outlet 22 being closed at this time. This permits water to flow through rim 110 into the toilet bowl to rinse it again and at the same time to replenish the water therein. From the position shown in FIG. 6, the second valve 31 progresses to the closed position shown in FIG. 3. The liquid flowing through the flush valve is then stopped.

It shold be noticed that the liquid in the second channel 16 behind the valve guide 34 would normally prevent the second valve returning to its rest position while the first valve 23 is closed. However, that water is drained from the channel 16 through the passageway 38 which is in communication with another opening 128 in the top of the toilet flange 90. The speed of draining, and thus the speed of the return of the valve 31, is variable by the valve 40.

As stated above, when valve 31 is in its rest position, the rounded portion of end 100 of guide 34 permits air to enter conduit 82 which is in communication with jet 112 of the toilet bowl. This prevents water from remaining in the bowl passage to the jet above the level of the water in the bowl.

As illustrated in FIG. 7, the water passing from the first outlet 22 is directed to jet 112 of the toilet bowl 91. The addition of the water to the jet starts a syphon over dam 115, and the toilet bowl is thus emptied by conventional means. The second outlet 48 directs the water to rinse rim 110. Rinse rims are conventional parts of all toilet bowls. There are openings (not shown) in the rim so that the water may flow from the rim 110 down the sides of the toilet bowl first in a rinsing action and second in a replenishing action.

Thus, in use the valve 10*a* directs the first supply of water to leave the valve through outlet 48 as shown in FIG. 4 into the flush rim 110. The toilet bowl is thus given a preliminary rinse. When second valve 31 reaches the position shown in FIG. 5 the main flushing action takes place. That is, the water is directed to and through the jet 112. When valve 31 reaches the position shown in FIG. 6 a final rinse and the replenishment of the water in the bowl takes place before the closing of the valve 31 prevents the further passage of water. It should be noted that by choice of the widths of the circumferential channel 54 and of the length of valve stem 33, the amount of water fed at each position of the second valve 31 can be easily regulated. Generally speaking the length of the stem 33 will be considerably longer than the width of the circumferential channel 56 because the final rinse is required to be of longer duration to replenish the water seal in the toilet bowl. For example, in a useful embodiment of the present invention with an overall flush valve length of approximately 10 ½ inches and with the second valve 31 of a length of approximately 5 ½ inches the stem 33 was approximately 1 ⅝ inches long and circumferential channel 56 had a width of approximately ¾ inch.

FIG. 11 illustrates still another embodiment of the invention, which is a simplified version of the valve illustrated in FIGS. 3 to 6. The alternative valve 10*b* includes flow valve 31 and its associated elements in channel 16. Channel 14, passages 18 and 20, and control valve 23 have been omitted. An inlet 130 is provided for valve body 12 instead of inlet 21. Inlet 130 is in communication with the end of channel 16 adjacent valve head 32. Lever 26 has a rod 132 connected thereto extending through the adjacent end of body 12 and into channel 16 to engage the end of guide 34 of valve 31. It is, however, preferable to interpose a spring 134 between the inner end of rod 132 and the valve guide. Another spring 136 in a housing 137 on the end of the valve body resiliently urges lever 26 outwardly, at which time valve head 32 rests against seat 35 when the flush valve is connected at inlet 130 to a water line.

Flush valve 10*b* is put into operation by movement of lever 26. Movement of the lever towards the body shifts valve 31 in passage 16 to lift head 32 off its seat, at which time water entering through outlet 130 can flow through outlet 48, while guide 34 blocks off outlet 22. Valve 10*b* now continues to operate in exactly the same manner as valve 10*a* described above.

Valve 10*b* functions as described, but it is considered to be not as satisfactory as valve 10*a.*

The present invention provides a flush valve that is cheap to manufacture and can be made from a relatively cheap synthetic resin, for example nylon. Furthermore, there is a considerable saving in the amount of water needed to flush. Initial experiments indicate that considerably less than half the amount is needed than for a conventional system. The valve can be installed extremely quickly as it is only necessary to place the valve in position and thread on the nut 94. There is then one water supply connection to be made to the inlet 21.

What I claim is:

1. Flush valve apparatus comprising:

a valve body;

a channel formed in said body, an inlet in communication with the channel near one end thereof, an outlet in communication with the channel and spaced from said one end, a flow valve in channel having a head, a stem of smaller cross section than the head and a guide portion that is a close, slidable fit in the channel and remote from the head, a valve seat in the channel between said one end and the outlet, said valve being reciprocal in the channel between a closed, rest position in which the valve head is located on the valve seat to a second position in which the head is in the vicinity of said one end, the flow valve being adapted to ensure that, in use, liquid can pass the head and out through the outlet at all positions except the closed position, and means to permit movement of the valve to move the head off the valve seat, whereby, in use, when the valve is moved to said second position liquid can pass from the inlet to the outlet and simultaneously move the valve gradually back to the closed, rest position to stop passage of liquid through the outlet.

2. Flush valve apparatus comprising:

a valve body;

first and second channels formed in the body and communicable with each other at first and second passages remote from each other;

an inlet in the first channel;

an outlet in the second channel;

a control valve in the first channel reciprocable between a rest position in which it blocks communication between the inlet and the first passage and a second position in which it blocks communication between the inlet and the second passage;

means to permit movement of the control valve between its rest and second positions;

a flow valve in the second channel having a head, a stem of smaller cross section than the head and a guide portion that is a close, slidable fit in the second channel and remote from the head;

a valve seat in the second channel, between the second passage and the outlet;

the flow valve being reciprocable in the second channel between a closed, rest position in which the valve head is seated on the valve seat to a second position in which the head of the valve is in the vicinity of the second passage, the flow valve being adapted to ensure that, in use, liquid can pass by the head of the flow valve out of the outlet at all positions of the flow valve except the closed position;

whereby, in use, when the control valve is moved to its second position, liquid can pass through the first passage to act against the guide of the flow valve to move the flow valve from the closed, rest position and enable liquid to pass through the second passage to the outlet and, simultaneously, to move the flow valve gradually back to the closed, rest position to stop passage of liquid through the outlet.

3. A valve as claimed in claim 2 provided with a second outlet in the second channel, the valve guide being elongated and formed with an internal channel, a first port in the channel relatively close to the valve head and communicating with the second channel, a second port in the guide portion of the valve able to communicate sequentially with the first and second outlets in the second channel, the second port being positioned so that when the flow valve is in its second position it communicates with the second coutlet and water from the first passes through the first port, through the internal channel in the valve, out of the second port and out of the second outlet and, as the flow valve moves towards its rest position, the second port communicates with the first outlet to enable liquid to pass through that outlet followed by communication of the area around the valve stem with the second outlet prior to the closing of the valve and while said valve guide closes the second outlet.

4. A valve as claimed in claim 1 including regulating outlet means communicating with the guide portion of the flow valve to permit the flow valve to return to its closed position and to control the speed of that return.

5. A valve as claimed in claim 2 including regulating outlet means communicating with the guide portion of the flow valve to permit the flow valve to return to its closed position and to control the speed of that return.

6. A valve as claimed in claim 3 including regulating outlet means communicating with the guide portion of the flow valve to permit the flow valve to return to its closed position and to control the speed of that return.

7. A flush valve as claimed in claim 1 in which the means to permit movement of the control valve is a reciprocable lever linked to the valve.

8. A flush valve as claimed in claim 2 in which the means to permit movement of the control valve is a reciprocable lever linked to the valve, and including spring means for the lever to move the control valve to its rest position.

9. A flush valve as claimed in claim 3 in which the means to permit movement of the control valve is a reciprocable lever linked to the valve, and including spring means for the lever to move the control valve to its rest position.

10. A valve as claimed in claim 1 in which the head of the flow valve is smaller in cross sectional area than that part of its channel swept by the head so that liquid may pass by the valve head and out of an outlet at all positions of the flow valve except the closed position.

11. A valve as claimed in claim 2 in which the head of the flow valve is smaller in cross sectional area than that part of its channel swept by the head so that liquid may pass by the valve head and out of an outlet at all positions of the flow valve except the closed position.

12. A valve as claimed in claim 3 in which the head of the flow valve is smaller in cross sectional area than that part of its channel swept by the head so that liquid may pass by the valve head and out of an outlet at all positions of the flow valve except the closed position.

13. A valve as claimed in claim 2 in which the part of the channel swept by the valve head is formed with by-pass channels to ensure that liquid can pass by the valve head and out of an outlet at all positions of the flow valve except the closed position.

14. A valve as claimed in claim 3 in which the part of the channel swept by the valve head is formed with by-pass channels to ensure that liquid can pass by the valve head and out of an outlet at all positions of the flow valve except the closed position.

15. A valve as claimed in claim 1 in which the valve body is formed with a hole at an end of each channel to permit insertion and removal of the control and flow valves respectively and in which each hole is provided with a liquid-proof plug.

16. A valve as claimed in claim 2 in which the valve body is formed with a hole at an end of each channel to permit insertion and removal of the control and flow valves respectively and in which each hold is provided with a liquid-proof plug.

17. A valve as claimed in claim 1 including regulating outlet means communicating with the guide portion of the flow valve to permit the flow valve to return to its closed position and to control the speed of that return; said regulating outlet means comprising an outlet formed in that part of the flow valve channel accommodating the end of the flow valve remote from the head thereof, the outlet having a valve whose position can be varied to govern the speed of emission of fluid as the flow valve moves to its closed, rest position.

18. A valve as claimed in claim 2 including regulating outlet means communicating with the guide portion of the flow valve to permit the flow valve to return to its closed position and to control the speed of that return; said regulating outlet means comprising an outlet formed in that part of the flow valve channel accommodating the end of the flow valve remote from the head thereof, the outlet having a valve whose position can be varied to govern the speed of emission of fluid as the flow valve moves to its closed, rest position.

19. A valve as claimed in claim 3 including regulating outlet means communicating with the guide portion of the flow valve to permit the flow valve to return to its closed position and to control the speed of that return; said regulating outlet means comprising an outlet formed in that part of the flow valve channel accommodating the end of the flow valve remote from the head thereof, the outlet having a valve whose position can be varied to govern the speed of emission of fluid as the flow valve moves to its closed, rest position

20. A valve as claimed in claim 2 in which there is a spring between the head of the flow valve and the adjacent end of its channel to absorb the shock of contact between said head and said channel end.

21. A valve as claimed in claim 3 in which there is a spring between the head of the flow valve and the adjacent end of its channel to absorb the shock of contact between said head and said channel end.

22. A valve as claimed in claim 2 including biasing means between the valve guide and the adjacent end of the channel of the flow valve remote from the end near the head tending to bias said head off the valve seat.

23. A valve as claimed in claim 3 including biasing means between the valve guide and the adjacent end of the channel of the flow valve remote from the end near the head tending to bias said head off the valve seat.

* * * * *